US009841194B2

(12) United States Patent
Paller

(10) Patent No.: US 9,841,194 B2
(45) Date of Patent: Dec. 12, 2017

(54) OVEN APPLIANCES HAVING IMPROVED OVEN BURNER AIR SUPPLIES

(71) Applicant: General Electric Company, Schenectady, NY (US)

(72) Inventor: Hans Juergen Paller, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 420 days.

(21) Appl. No.: 14/742,968

(22) Filed: Jun. 18, 2015

(65) Prior Publication Data

US 2016/0370015 A1 Dec. 22, 2016

(51) Int. Cl.
*F24C 3/00* (2006.01)
*F24C 3/08* (2006.01)

(52) U.S. Cl.
CPC ..... *F24C 3/00* (2013.01); *F24C 3/087* (2013.01)

(58) Field of Classification Search
None
See application file for complete search history.

(56) References Cited

U.S. PATENT DOCUMENTS 2,041,706 A 5/1936 Hahn
5,103,545 A 4/1992 Riehl
6,578,570 B2 * 6/2003 Fogliani ..... F23D 14/105 126/512
8,764,437 B2 * 7/2014 Ryu ..... F23D 14/065 126/39 E
2014/0158110 A1 * 6/2014 Braden ..... F24C 3/087 126/39 E
2014/0305424 A1 * 10/2014 Braden ..... F24C 3/085 126/39 E

FOREIGN PATENT DOCUMENTS

JP 60221624 A * 11/1985 ..... F24C 3/087

* cited by examiner

*Primary Examiner* — David J Laux
(74) *Attorney, Agent, or Firm* — Dority & Manning, P.A.

(57) ABSTRACT

An oven appliance includes a cabinet defining a cooking chamber. The oven appliance further includes a gas burner assembly, the gas burner assembly including a burner tube disposed within the cooking chamber adjacent a top wall. The burner tube defines a passage extending from an inlet and further defines a plurality of outlet ports. The oven appliance further includes a conduit defined within the cabinet, the conduit defining a passage disposed exterior to the cooking chamber, the passage extending from an inlet. The conduit further defines a plurality of outlet apertures. The oven appliance further includes a duct defining a passage extending between an inlet and an outlet. The outlet is in fluid communication with the inlet of the burner tube for flowing primary air through the burner tube and in fluid communication with the inlet of the conduit for flowing secondary air through the conduit.

15 Claims, 5 Drawing Sheets

OVEN APPLIANCES HAVING IMPROVED OVEN BURNER AIR SUPPLIES

FIELD OF THE INVENTION

The present disclosure relates generally to oven appliances, and more particularly to oven appliances which include features for improving the primary and secondary air supplies to oven burners thereof.

BACKGROUND OF THE INVENTION

Conventional residential and commercial oven appliances generally include a cabinet that defines a cooking chamber for receipt of food items for cooking. Heating elements are positioned within the cooking chamber to provide heat to food items located therein. The heating elements can include, for example, radiant heating elements, such as a bake heating element positioned at a bottom of the cooking chamber and/or a broil heating element positioned at a top of the cooking chamber.

In many cases one or more heating elements, such as the broil heating element, may be gas-based heating elements. Combustion of a supplied fuel, such as a gaseous fuel, is thus required for heat to be generated by such heating elements, and air is required for mixing with the fuel for combustion to occur. The air that is utilized for combustion in an oven appliance is typically categorized as either primary air or secondary air. Primary air is the air that mixes with fuel prior to initial combustion, while secondary air is air that mixes with the combusted working fluid/flame after combustion has been initiated.

One issue with known oven appliances is the need to supply sufficient primary and secondary air while maintaining the efficiency of the oven appliance. The primary air supply is typically limited by the pressure and velocity at which it can be injected into the gas-based heating element. Secondary air is typically limited by the oven size and the size of the vents into the cooking chamber of the oven for allowing secondary air into the cooking chamber. However, as oven size and vent size are increased, the efficiency of the oven decreases.

On approach to improving the air supply has been to supply the primary air from outside of the cooking chamber. However, many currently utilized approaches suffer from backpressure issues due to pressure increases in the cooking chamber when the temperature in the cooking chamber rises. Other approaches have utilized complicated fan-assisted designs, but these designs are costly and typically require increased maintenance and are thus undesirable.

Accordingly, improved oven appliances are desired. In particular, oven appliances which provide improved primary and secondary air supplies for gas-based heating element combustion, and which are efficient and cost-effective, would be advantageous.

BRIEF DESCRIPTION OF THE INVENTION

In accordance with one embodiment, an oven appliance is provided. The oven appliance includes a cabinet defining a cooking chamber, the cooking chamber configured for receipt of items to be cooked and including a top wall and a bottom wall spaced from the top wall along a vertical direction. The oven appliance further includes a gas burner assembly, the gas burner assembly including a burner tube disposed within the cooking chamber adjacent the top wall. The burner tube defines a passage extending from an inlet and further defines a plurality of outlet ports, each of the plurality of outlet ports providing fluid communication between the passage and the cooking chamber. The oven appliance further includes a conduit defined within the cabinet, the conduit defining a passage disposed exterior to the cooking chamber, the passage extending from an inlet. The conduit further defines a plurality of outlet apertures, each of the plurality of outlet apertures providing fluid communication between the passage and the cooking chamber. The oven appliance further includes a duct defining a passage extending between an inlet and an outlet, the passage disposed exterior to the cooking chamber. The outlet is in fluid communication with the inlet of the burner tube for flowing primary air through the inlet of the burner tube and in fluid communication with the inlet of the conduit for flowing secondary air through the inlet of the conduit.

In accordance with another embodiment, an oven appliance is provided. The oven appliance includes a cabinet defining a cooking chamber, the cooking chamber configured for receipt of items to be cooked and including a top wall and a bottom wall spaced from the top wall along a vertical direction. The oven appliance further includes an upper gas burner assembly, the gas burner assembly including a burner tube disposed within the cooking chamber adjacent the top wall. The burner tube defines a passage extending from an inlet and further defines a plurality of outlet ports, each of the plurality of outlet ports providing fluid communication between the passage and the cooking chamber. The oven appliance further includes a lower burner assembly, the lower burner assembly including a heating element disposed within the cooking chamber adjacent the bottom wall. The oven appliance further includes a conduit defined within the cabinet, the conduit defining a passage disposed exterior to the cooking chamber, the passage extending from an inlet. The conduit further defines a plurality of outlet apertures, each of the plurality of outlet apertures providing fluid communication between the passage and the cooking chamber. The oven appliance further includes a duct defining a passage extending vertically between an inlet and an outlet, the passage disposed exterior to the cooking chamber. The outlet is in fluid communication with the inlet of the burner tube for flowing primary air through the inlet of the burner tube and in fluid communication with the inlet of the conduit for flowing secondary air through the inlet of the conduit. The oven appliance further includes a fan disposed within the duct, the fan operable to direct the flow of primary air and secondary air towards the outlet.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION OF THE INVENTION

Figure 1:
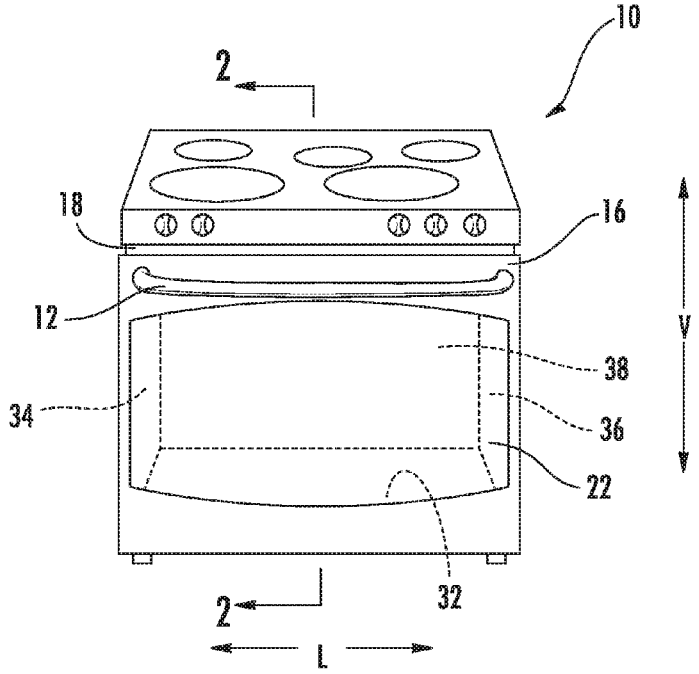
FIG. 1 provides a perspective view of an oven appliance in accordance with one embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
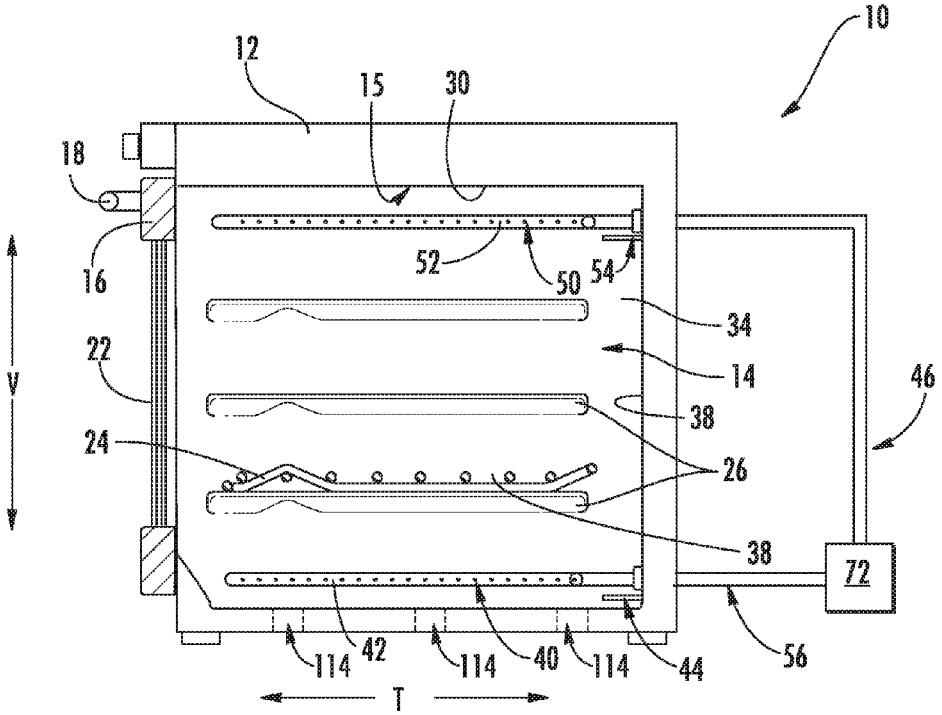
FIG. 2 provides a sectional view of the oven appliance of FIG. 1 taken along the line 2-2 of FIG. 1.
Figure 3:
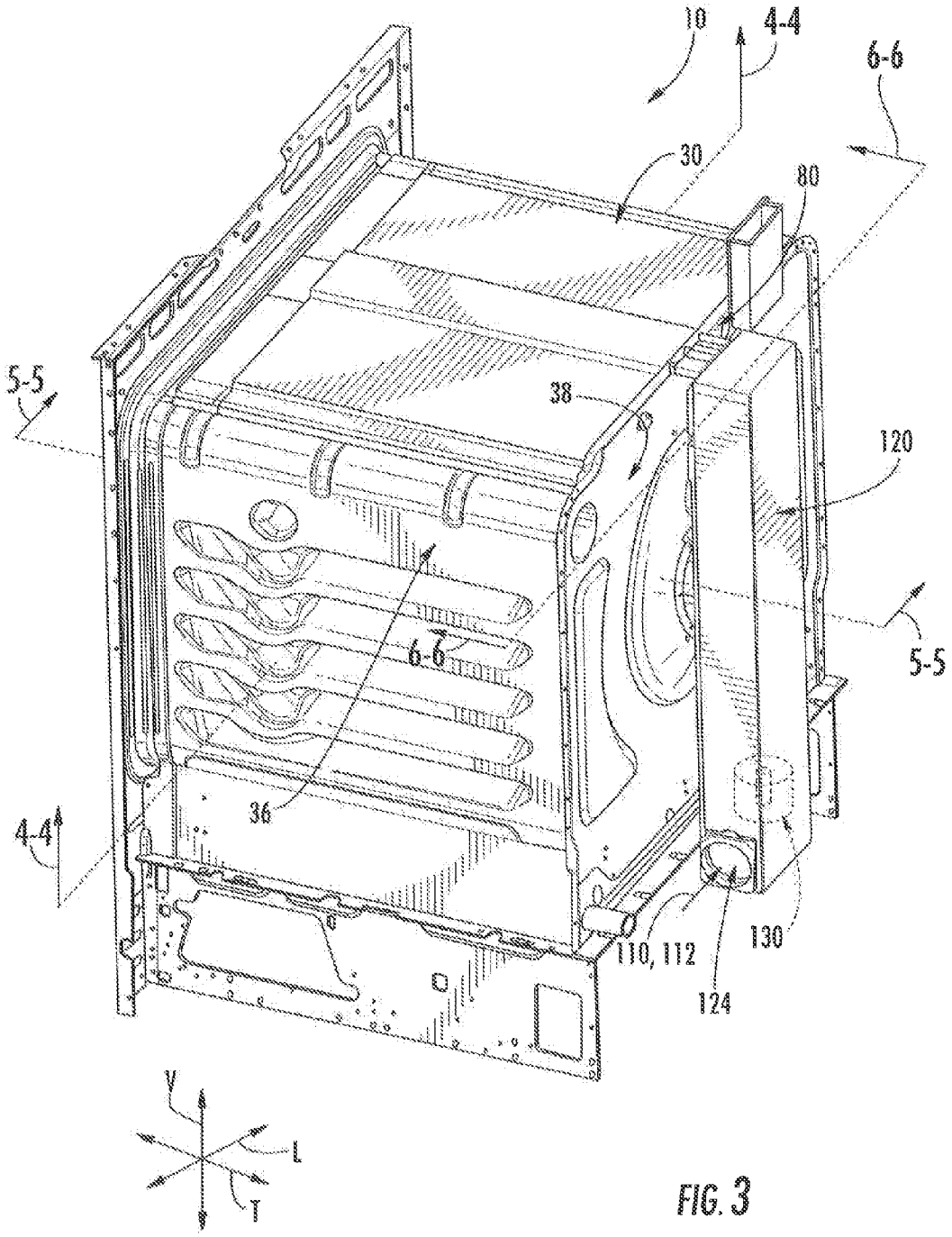
FIG. 3 is a perspective view of components of an oven appliance in accordance with one embodiment of the present disclosure.
Figure 4:
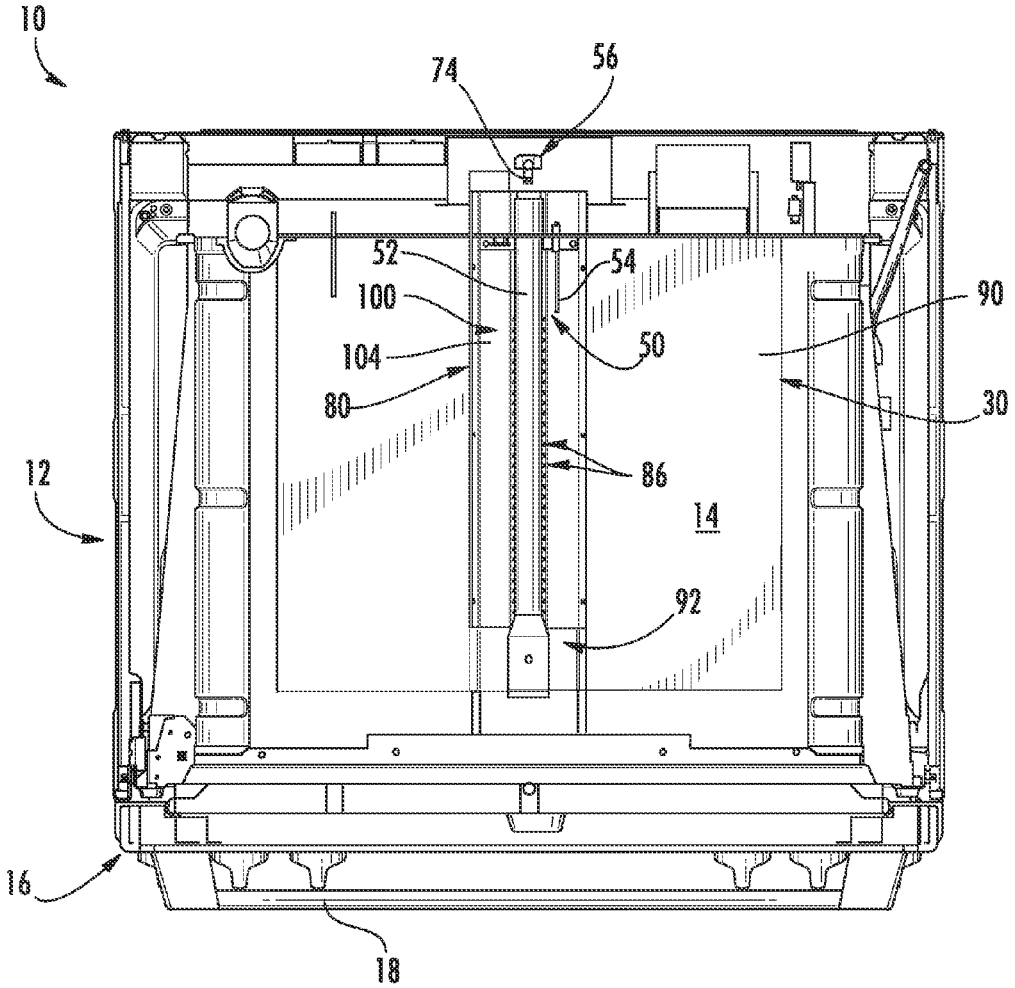
FIG. 4 is a cross-sectional view of the oven appliance of FIG. 3 taken along the line 4-4 of FIG. 3.
Figure 4:
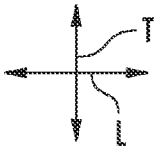
Figure 5:
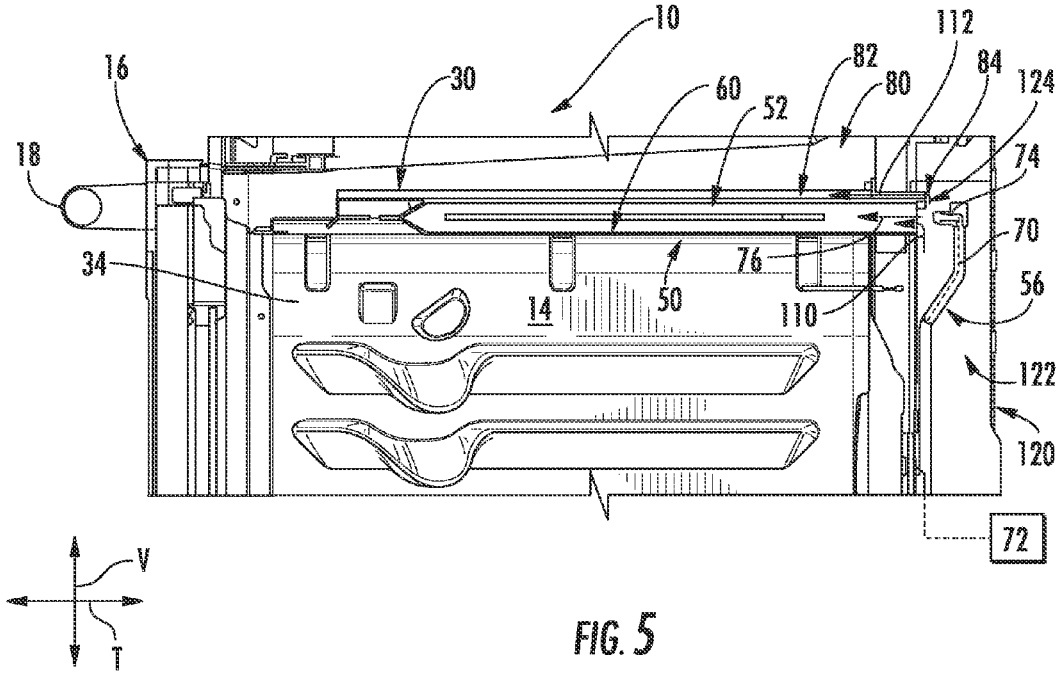
FIG. 5 is a cross-sectional view of the oven appliance of FIG. 3 taken along the line 5-5 of FIG. 3.
Figure 6:
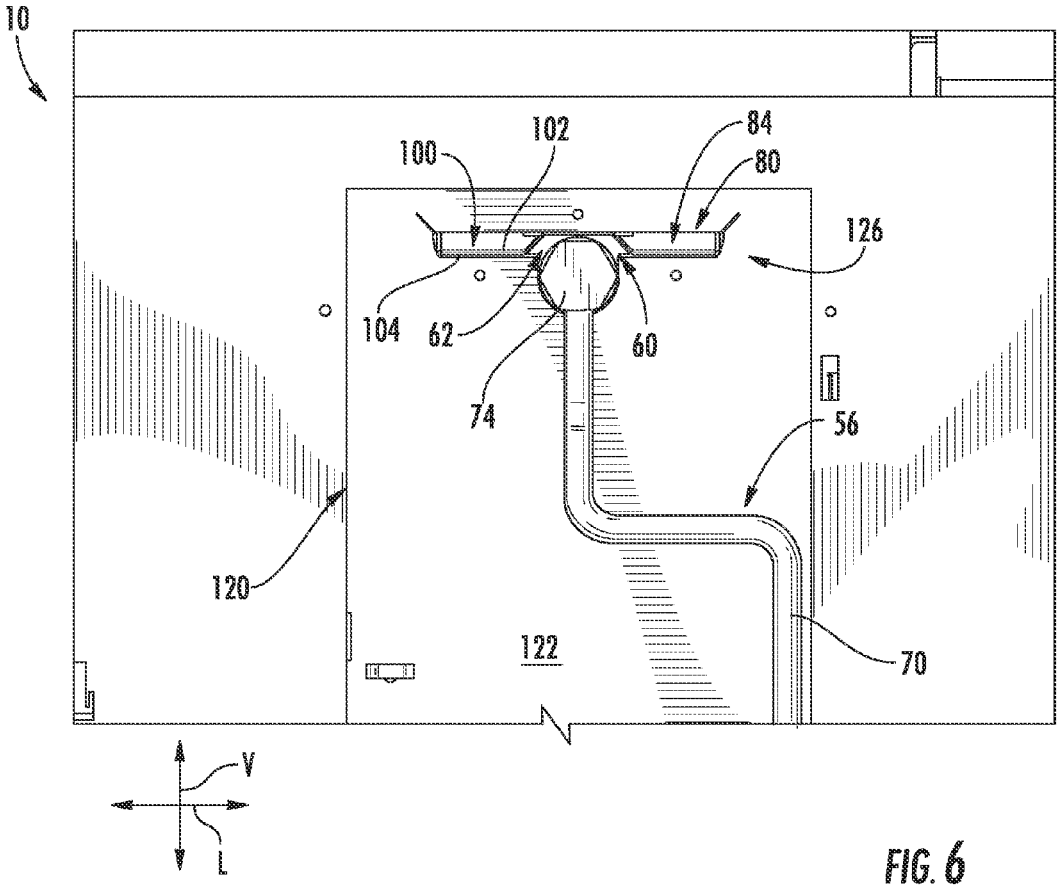
FIG. 6 is a cross-sectional view of the oven appliance of FIG. 3 taken along the line 6-6 of FIG. 3.
Figure 7:
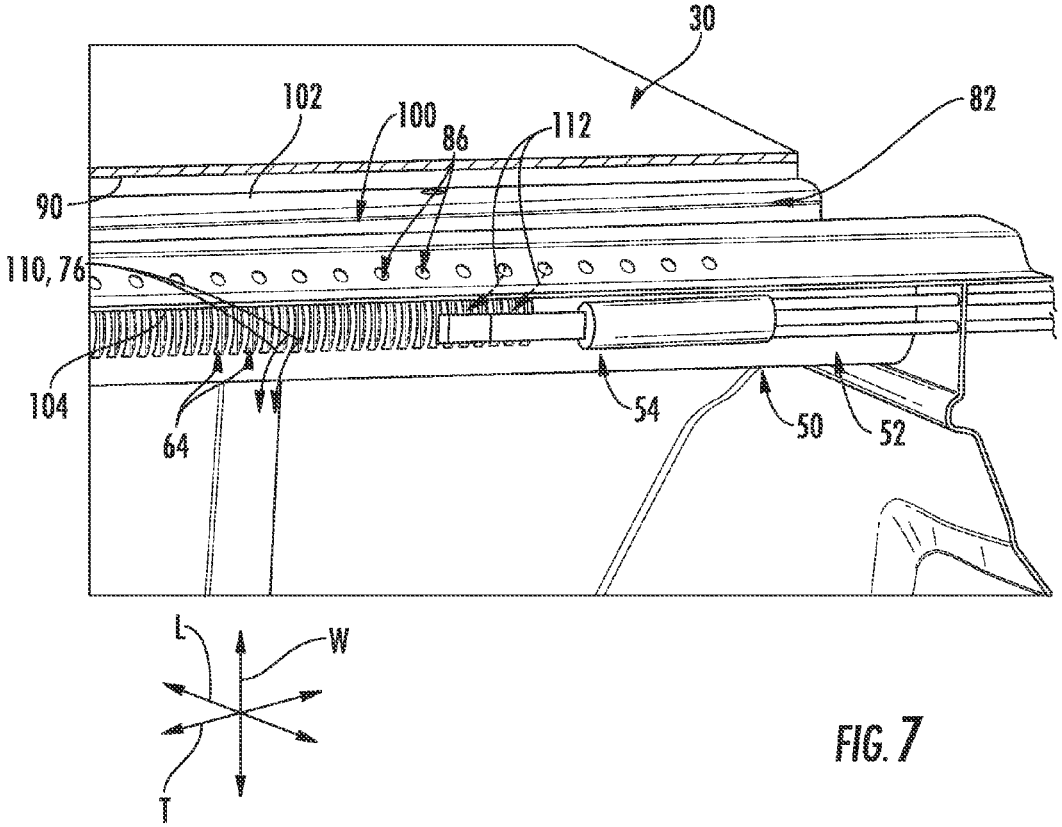
FIG. 7 is a close-up perspective view of components of an oven appliance in accordance with one embodiment of the present disclosure.

FIG. 1 provides a perspective view of an oven appliance 10 according to an exemplary embodiment of the present subject matter. FIG. 2 provides a section view of oven appliance 10 taken along the 2-2 line of FIG. 1. Oven appliance 10 defines a vertical direction V, a lateral direction L and a transverse direction T. The vertical, lateral and transverse directions are mutually perpendicular and form an orthogonal direction system. As will be understood by those skilled in the art, oven appliance 10 is provided by way of example only, and the present subject matter may be used in any suitable oven appliance. Thus, the present subject matter may be used with other oven or range appliance configurations, e.g., that define multiple interior cavities for the receipt of food and/or having different pan or rack arrangements than what is shown in FIG. 2.

Oven appliance 10 includes an insulated cabinet 12 with an interior cooking chamber 14 defined by an interior surface 15 of cabinet 12. Cooking chamber 14 is configured for the receipt of one or more food items to be cooked. Oven appliance 10 includes a door 16 rotatably mounted to cabinet 12, e.g., with a hinge (not shown). A handle 18 is mounted to door 16 and assists a user with opening and closing door 16 in order to access cooking chamber 14. For example, a user can pull on handle 18 to open or close door 16 and access cooking chamber 14.

Oven appliance 10 can includes a seal (not shown) between door 16 and cabinet 12 that assist with maintaining heat and cooking fumes within cooking chamber 14 when door 16 is closed as shown in FIG. 2. Multiple parallel glass panes 22 provide for viewing the contents of cooking chamber 14 when door 16 is closed and assist with insulating cooking chamber 14. A baking rack 24 is positioned in cooking chamber 14 for the receipt of food items or utensils containing food items. Baking rack 24 is slidably received onto embossed ribs 26 or sliding rails such that rack 24 may be conveniently moved into and out of cooking chamber 14 when door 16 is open.

As shown, various sidewalls define the cooking chamber 14. For example, cooking chamber 14 includes a top wall 30 and a bottom wall 32 which are spaced apart along the vertical direction V. Left sidewall 34 and right sidewall 36 (as defined according to a front view as shown in FIG. 2) extend between the top wall 30 and bottom wall 32, and are spaced apart along the lateral direction L. A rear wall 38 may additionally extend between the top wall 30 and bottom wall 32 as well as between the left sidewall 34 and right sidewall 36, and is spaced apart from the door 16 along the transverse direction T. Cooking chamber 14 is thus defined between the top wall 30, bottom wall 32, left sidewall 34, right sidewall 36, and rear wall 38.

A lower burner assembly 40, e.g., a bake burner assembly may be included in oven appliance 10. Lower burner assembly 40 may include a heating element 42 which is disposed within the cooking chamber 14, such as adjacent the bottom wall 32. In exemplary embodiments as illustrated, the lower burner assembly 40 is a gas burner assembly, and the heating element 42 is thus a gas burner tube. Lower burner assembly 40 may additionally include an igniter 44. A fuel supply line 46 may supply a suitable fuel to the heating element 42 for combustion. Alternatively, the lower burner assembly 40 may be an electric burner assembly and thus include an electric heating element, or may be any other suitable burner assembly having any other suitable heating element.

As discussed in detail herein, an upper burner assembly 50, e.g., a broil burner assembly may be included in oven appliance 10. Upper burner assembly 50 may include a heating element 52 which is disposed within the cooking chamber 14, such as adjacent the top wall 30. The upper burner assembly 50 is a gas burner assembly, and the heating element 52 is thus a gas burner tube. Upper burner assembly 50 may additionally include an igniter 54. A fuel supply line 56 may supply a suitable fuel to the heating element 52 for combustion.

Referring now to FIGS. 2 through 7, oven appliance 10 includes various features which facilitate improved air supply and thus improved combustion for gas burner assemblies of the oven appliance 10. While the embodiments provided illustrate use of such features in conjunction with upper gas burner assembly 50, it should be understood that the present disclosure is not limited to such embodiments, and that the features discussed herein may be utilized with any suitable gas burner assembly of any suitable oven appliance. In general, such features improve the supply of both primary and secondary air. Additionally, such features may be cost effective and relatively easy to maintain, and may allow for maintained or improved efficiency of the oven appliance relative to known oven appliances.

As mentioned, a gas burner assembly 50 may be provided in oven appliance 10. The gas burner assembly 50 may include a burner tube 52 which is disposed within the cooking chamber 14, such as adjacent the top wall 30. As shown, burner tube 52 may define a passage 60 which extends from an inlet 62. When positioned within the cooking chamber 14, the passage 60 may for example extend generally along the transverse direction T from the inlet 62 or in another suitable direction from the inlet 62. Passage 60 may, for example, extend generally linearly from inlet 62. Additionally, a plurality of outlet ports 64 may be defined in the burner tube 52. Each outlet port 64 may provide fluid communication between the passage 60 and the cooking chamber 14.

The outlet ports 64 may, for example, be positioned in a plurality of rows of outlet ports 64, each row extending from inlet 62 such as along the line of the passage 60. In exemplary embodiments, the outlet ports 64 are extruded slots defined the burner tube 52. The outlet ports 64 may be suitable sized and shaped to facilitate supply and combustion of air and fuel to cooking chamber 14 and oven appliance 10 generally.

As additionally mentioned, gas burner assembly 50 may additionally include an igniter 54. Igniter 54 may be disposed with the cooking chamber 14, such as adjacent to the burner tube 52. Igniter 54 may provide a combustion source, such as a hot surface igniter or spark, which causes combustion of an air-fuel mixture from the burner tube 52.

Further, a fuel supply line 56 may provide a suitable fuel to gas burner assembly 50, such as to burner tube 52 thereof, for combustion. The fuel supply line 56 may, for example, include a line 70 extending from a fuel supply 72, and may further include a nozzle 74 for exhausting fuel 76 into the passage 60, such as through the inlet 62.

Oven appliance 10 may further include a conduit 80 defined within the cabinet 12. Conduit 80 may define a passage 82 which is disposed exterior to the cooking chamber 14, such as in exemplary embodiments above the top wall 30 along the vertical direction V. Passage 82 may, for example, extend from an inlet 84, such as generally along the transverse direction T from the inlet 62 or in another suitable direction from the inlet 62. Passage 82 may, for example, extend generally linearly from inlet 84. Additionally, a plurality of outlet apertures 86 may be defined in the conduit 80. Each outlet aperture 86 may provide fluid communication between the passage 82 and the cooking chamber 14. The outlet apertures 86 may, for example, be positioned in a plurality of rows of outlet apertures 86, each row extending from inlet 84 such as along the line of the passage 82.

In some embodiments, as illustrated, top wall 30 may partially define the passage 82 of conduit 80. For example, top wall 30 may include an inner surface 90 which faces the cooking chamber 14. A portion 92 of the inner surface 90 may partially define the passage 82. This portion 92 may, for example, be a raised portion (along the vertical direction V relative to the neighboring portions of the top wall 30) of top wall 30 as shown, or may simply be a portion that partially defines the passage 82 due to interaction with other components to define the passage 82.

Further, a panel 100 may be included in oven appliance 10 to further define the passage 82. Panel 100 may include a top surface 102 and an opposing bottom surface 104. The bottom surface 104 may partially define the cooking chamber 14. For example, bottom surface 104 may be a portion of interior surface 15 defining cooking chamber 14. The bottom surface 104 may, along with remaining portions of the top wall 30 other than portion 92, define an upper boundary of the cooking chamber 14. Top surface 102 may partially define the passage 82. For example, top surface 102 and portion 92 of top wall 30 may together define or at least partially define the passage 82.

In exemplary embodiments, outlet apertures 86 are defined in the panel 100. As shown, for example, each outlet aperture 86 may extend between the top surface 102 and the bottom surface 104 to provide the fluid communication between the passage 82 and chamber 14.

During operation of the oven appliance, primary air 110 may flow into and through passage 60 of burner tube 52 for combustion with fuel 76. Secondary air 112 may additionally be provided for mixing with the working fluid which results from combustion of the primary air 110 and fuel 76. Secondary air 112 may be provided through vents 114 defined in the oven appliance 10, such as in the bottom wall 32, further advantageously, secondary air may be flowed into and through passage 82 of conduit 80, and then through outlet apertures 86 into cooking chamber 14.

For example, as illustrated, oven appliance 10 may further advantageously include a duct 120 through which primary air 110 may be supplied to passage 60 and secondary air 112 may be supplied to passage 82. Duct 120 may define a passage 122 which extends between an inlet 124 and an outlet 126. The passage 122 may be disposed exterior to the cooking chamber 14, and may further be disposed interior to or exterior to the cabinet 12. Inlet 124 may be in fluid communication with ambient air exterior to the oven appliance 10 generally. Outlet 126 may be in fluid communication with the inlet 62 of the burner tube 52 for flowing primary air 110 through the inlet 62 of the burner tube 52. Outlet 126 may additionally be in fluid communication with the inlet 84 of conduit 80 for flowing secondary air 112 through the inlet 84 of the conduit 80. Accordingly, air generally (including primary air 110 and secondary air 112 components) may be flowed into passage 122 through inlet 124. A portion of the air, i.e. primary air 110 may then exit outlet 126 into inlet 62, while another portion of the air, i.e. secondary air 112 may then exit outlet 126 into 84.

It should be understood that outlet 126 may be a single opening (as shown) or alternatively, may be multiple openings, such as for example a first opening in fluid communication with inlet 62 and a second opening in fluid communication with inlet 84. Passage 122 similarly may include a single channel or multiple channels, as desired or required.

In exemplary embodiments, as illustrated, duct 120 may extend vertically (along the vertical direction V) between the inlet 124 and the outlet 126. Alternatively, duct 120 may extend at an angle to the vertical direction V or in another suitable direction. In exemplary embodiments, inlet 124 may be below outlet 126, and outlet 126 above the inlet 124, with respect to the vertical direction V. Inlet 124 may, for example, be adjacent bottom wall 32. Outlet 126 may, for example, be adjacent top wall 30.

As further illustrated, in exemplary embodiments, one or more fans 130 may advantageously be provided and disposed within the duct 120, such as with the passage 122 thereof. Fan 130 may be operable to direct the flow of primary air 110 and secondary air 112 through the passage 122, such as towards the outlet 126. Use of fans 130 in accordance with the present disclosure may assist in overcoming any backpressure issues during operation of the oven appliance 10.

Fan 130 may in exemplary embodiments be a dedicated fan for flowing primary air 110 and secondary air 112 in accordance with the present disclosure, and may not be utilized for other purposes such as convection cooking, cooling between a cooktop and cooking chamber 14, etc.

Notably, in some embodiments, at least a portion of the fuel supply line 56 may be disposed within passage 122. For example, nozzle 74 and/or a portion of line 70 may be disposed within passage 122. In embodiments wherein nozzle 74 is disposed within passage 122, fuel 76 may be emitted from nozzle 74 in passage 122 towards and into passage 60 through inlet 62. The fuel 76 may mix with primary air 110 as the fuel 76 and primary air 110 enter the passage 60 through inlet 62 and/or within passage 60.

Use of ducts 120 and conduits 80 in accordance with the present disclosure advantageously facilitate improved, efficient air supplies to oven appliances 10. As discussed, duct 120 advantageously flows both primary air 110 and secondary air 112 therethrough, and facilitates mixing of primary air 110 with fuel 76 for combustion via burner tube 52.

Further, duct 120 facilitates the flow of secondary air 112 into conduit 80, and flow of this secondary air 112 from conduit 80 into cooking chamber 14. Advantageously, the location of the conduit 80 adjacent burner assembly 50 facilitates improved mixing between combusted working fluid and secondary air 112. Further, secondary air 112 flowing through outlet apertures 86 into cooking chamber 14 may, due to such adjacent location, advantageously provide cooling of the igniter 54. Such supply of primary air 110 and secondary air 112 advantageously improves the performance of the burner assembly 50 and thus the oven appliance 10 generally.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An oven appliance, comprising:

a cabinet defining a cooking chamber, the cooking chamber configured for receipt of items to be cooked and comprising a top wall and a bottom wall spaced from the top wall along a vertical direction;

a gas burner assembly, the gas burner assembly comprising a burner tube disposed within the cooking chamber adjacent the top wall, the burner tube defining a passage extending from an inlet and further defining a plurality of outlet ports, each of the plurality of outlet ports providing fluid communication between the passage and the cooking chamber;

a conduit defined within the cabinet, the conduit defining a passage disposed exterior to the cooking chamber, the passage extending from an inlet, and further defining a plurality of outlet apertures, each of the plurality of outlet apertures providing fluid communication between the passage and the cooking chamber;

a duct defining a passage extending between an inlet and an outlet, the passage disposed exterior to the cooking chamber, the outlet in fluid communication with the inlet of the burner tube for flowing primary air through the inlet of the burner tube and in fluid communication with the inlet of the conduit for flowing secondary air through the inlet of the conduit; and, a panel, the panel comprising a top surface and an opposing bottom surface, the bottom surface partially defining the cooking chamber, the top surface partially defining the passage of the conduit, wherein the plurality of outlet apertures are defined in the panel, each of the plurality of outlet apertures extending between the top surface and the bottom surface.

2. The oven appliance of claim 1, wherein the duct extends vertically between the inlet and the outlet.

3. The oven appliance of claim 1, further comprising a fan disposed within the duct, the fan operable to direct the flow of primary air and secondary air towards the outlet.

4. The oven appliance of claim 1, wherein the top wall partially defines the passage of the conduit.

5. The oven appliance of claim 1, further comprising a fuel supply line, the fuel supply line comprising a nozzle for exhausting fuel into the passage of the burner tube.

6. The oven appliance of claim 5, wherein at least a portion of the fuel supply line is disposed within the passage of the duct.

7. The oven appliance of claim 1, wherein the gas burner assembly further comprises an igniter, the igniter disposed within the cooking chamber adjacent to the burner tube.

8. The oven appliance of claim 1, further comprising a lower burner assembly, the lower burner assembly comprising a heating element disposed within the cooking chamber adjacent the bottom wall.

9. The oven appliance of claim 1, wherein the lower burner assembly is a gas burner assembly and the heating element is a gas burner tube.

10. An oven appliance, comprising:

a cabinet defining a cooking chamber, the cooking chamber configured for receipt of items to be cooked and comprising a top wall and a bottom wall spaced from the top wall along a vertical direction;

an upper gas burner assembly, the gas burner assembly comprising a burner tube disposed within the cooking chamber adjacent the top wall, the burner tube defining a passage extending from an inlet and further defining a plurality of outlet ports, each of the plurality of outlet ports providing fluid communication between the passage and the cooking chamber;

a lower burner assembly, the lower burner assembly comprising a heating element disposed within the cooking chamber adjacent the bottom wall;

a conduit defined within the cabinet, the conduit defining a passage disposed exterior to the cooking chamber, the passage extending from an inlet, and further defining a plurality of outlet apertures, each of the plurality of outlet apertures providing fluid communication between the passage and the cooking chamber;

a duct defining a passage extending vertically between an inlet and an outlet, the passage disposed exterior to the cooking chamber, the outlet in fluid communication with the inlet of the burner tube for flowing primary air through the inlet of the burner tube and in fluid communication with the inlet of the conduit for flowing secondary air through the inlet of the conduit;

a fan disposed within the duct, the fan operable to direct the flow of primary air and secondary air towards the outlet; and, a panel, the panel comprising a top surface and an opposing bottom surface, the bottom surface partially defining the cooking chamber, the top surface partially defining the passage of the conduit, wherein the plurality of outlet apertures are defined in the panel, each of the plurality of outlet apertures extending between the top surface and the bottom surface.

11. The oven appliance of claim 10, wherein the top wall partially defines the passage of the conduit.

12. The oven appliance of claim 10, further comprising a fuel supply line, the fuel supply line comprising a nozzle for exhausting fuel into the passage of the burner tube.

13. The oven appliance of claim 12, wherein at least a portion of the fuel supply line is disposed within the passage of the duct.

14. The oven appliance of claim 10, wherein the gas burner assembly further comprises an igniter, the igniter disposed within the cooking chamber adjacent to the burner tube.

15. The oven appliance of claim 10, wherein the lower burner assembly is a gas burner assembly and the heating element is a gas burner tube.

* * * * *